US008269803B2

(12) United States Patent
Yoo et al.

(10) Patent No.: US 8,269,803 B2
(45) Date of Patent: Sep. 18, 2012

(54) DISPLAY DEVICE AND METHOD FOR DRIVING THE SAME

(75) Inventors: Myoung-Hwan Yoo, Yongin (KR); Choon-Yul Oh, Yongin (KR); Naoaki Komiya, Yongin (KR); Ho-Ryun Chung, Yongin (KR); Joo-Hyeon Jeong, Yongin (KR); Wang-Jo Lee, Yongin (KR); In-Ho Choi, Yongin (KR); Chang-Ho Hyun, Yongin (KR); Woung Kim, Yongin (KR)

(73) Assignee: Samsung Mobile Display Co., Ltd., Nongseo-Dong, Giheung-Gu, Yongin, Gyunggi-Do (KR)

( * ) Notice: Subject to any disclaimer, the term of this patent is extended or adjusted under 35 U.S.C. 154(b) by 69 days.

(21) Appl. No.: 12/985,618

(22) Filed: Jan. 6, 2011

(65) Prior Publication Data

US 2011/0254871 A1 Oct. 20, 2011

(30) Foreign Application Priority Data

Apr. 14, 2010 (KR) ..... 10-2010-0034329

(51) Int. Cl.
*G09G 5/10* (2006.01)

(52) U.S. Cl. ..... 345/690; 345/73; 345/76

(58) Field of Classification Search ..... 345/73–86, 345/690

See application file for complete search history.

(56) References Cited

U.S. PATENT DOCUMENTS

| | | | | |
|---|---|---|---|---|
| 7,403,176 | B2 | 7/2008 | Chung et al. | |
| 7,696,521 | B2 | 4/2010 | Lee et al. | |
| 7,701,421 | B2 | 4/2010 | Ogura | |
| 2007/0024543 | A1 * | 2/2007 | Chung et al. | 345/76 |
| 2009/0213049 | A1 | 8/2009 | McCreary | |
| 2010/0103083 | A1 * | 4/2010 | Shin et al. | 345/76 |
| 2011/0080437 | A1 * | 4/2011 | Yamashita et al. | 345/690 |
| 2011/0109813 | A1 * | 5/2011 | Toyomura et al. | 348/739 |

FOREIGN PATENT DOCUMENTS

| | | | |
|---|---|---|---|
| KR | 100846970 | B1 | 7/2008 |
| KR | 100858615 | B1 | 9/2008 |
| KR | 1020080085575 | A | 9/2008 |
| KR | 1020090073464 | A | 7/2009 |
| KR | 1020090129336 | A | 12/2009 |

* cited by examiner

*Primary Examiner* — Amare Mengistu
*Assistant Examiner* — Premal Patel
(74) *Attorney, Agent, or Firm* — Robert E. Bushnell, Esq.

(57) ABSTRACT

A display device includes a plurality of pixels, each of said plurality of pixels includes a driving transistor and a light emitting diode, a compensator to receive first and second pixel currents generated by the plurality of pixels according to first and second data voltages respectively applied to the plurality of pixels, the compensator to calculate an image data compensation amount to compensate for variations in characteristics of the driving transistor of each of said plurality of pixels and a data selector to transmit the first and second data voltages to the plurality of pixels and to transmit the first and second pixel currents to the compensator, the compensator to measure the first and second pixel currents generated as a result of the first and second data voltages corresponding to different gray scale levels and to calculate an actual threshold voltage and mobility of the driving transistor of each of the pixels, the compensator including a measurement resistor, the compensator to control a resistance value of the measurement resistor, the measurement resistor to convert the first pixel current corresponding to the first data voltage into a first measured voltage and the second pixel current corresponding to the second data voltage into a second measured voltage.

28 Claims, 5 Drawing Sheets

DISPLAY DEVICE AND METHOD FOR DRIVING THE SAME

CLAIM OF PRIORITY

This application makes reference to, incorporates the same herein, and claims all benefits accruing under 35 U.S.C. §119 from an application earlier filed in the Korean Intellectual Property Office on Apr. 14, 2010 and there duly assigned Serial No. 10-2010-0034329.

BACKGROUND OF THE INVENTION

1. Field of the Invention

The present invention relates to a display device that compensates for variations in characteristics of driving transistors of pixels and a method of driving the same.

2. Description of the Related Art

Recently, various flat panel display devices having reduced weight and volume, which are unfavorable aspects of a cathode ray tube, have been developed. Examples of flat panel display devices include liquid crystal displays, field emission displays, plasma display panels, organic light emitting displays, and others.

Among these flat panel display devices, the organic light emitting display displays images using an organic light emitting diode that generates light through the recombination of electrons and holes. Attention has been particularly paid to the organic light emitting display, which has a fast response speed, is driven with low power consumption, and exhibits excellent luminous efficiency, luminance, and viewing angle.

Typically, the organic light emitting displays (OLEDs) are classified into a passive matrix OLED (PMOLED) and an active matrix OLED (AMOLED) according to a driving scheme of an organic light emitting diode. The AMOLED selecting and lighting each unit pixel has been mainly used in view of better resolution, contrast, and operation speed.

Each pixel of the active matrix OLED includes an organic light emitting diode, a driving transistor that controls the amount of current supplied to the organic light emitting diode, and a switching transistor that transmits a data signal to the driving transistor in order to control the amount of light emitted from the organic light emitting diode.

The driving transistor has to be continuously turned on so that the organic light emitting diode can emit light. In the case of a large panel, variations in characteristics of the driving transistors of different pixels exist, and a moiré pattern is generated due to the variations in the characteristics. The variations in the characteristics of the driving transistors indicate variations in threshold voltage and mobility of the driving transistors. Even if the same data voltage is transmitted to gate electrodes of each of the driving transistors, the currents flowing through the driving transistors are different from each other depending on the variations in the characteristics of the plurality of driving transistors.

As a result, the moiré phenomenon occurs, and thereby image quality characteristics are deteriorated. Thus, it is necessary to compensate for these variations of driving transistors between pixels of a display device in order to improve the image quality.

The above information disclosed in this Background section is only for enhancement of understanding of the background of the invention, and therefore it may contain information that does not constitute prior art as per 35 U.S.C. §102 to a person of ordinary skill in the art.

SUMMARY OF THE INVENTION

The present invention has been made in an effort to provide a display device that can accurately measure variations in characteristics of driving transistors of a pixel circuit of different pixels and compensate for these variations more precisely.

According to one aspect of the present invention, there is provided a display device including a plurality of pixels, each of said plurality of pixels includes a driving transistor and a light emitting diode, a compensator to receive first and second pixel currents generated by the plurality of pixels according to first and second data voltages respectively applied to the plurality of pixels, the compensator to calculate an image data compensation amount to compensate for variations in characteristics of the driving transistor of each of said plurality of pixels, and a data selector to transmit the first and second data voltages to the plurality of pixels and to transmit the first and second pixel currents to the compensator, the compensator to measure the first and second pixel currents generated as a result of the first and second data voltages corresponding to different gray scale levels and to calculate an actual threshold voltage and mobility of the driving transistor of each of the pixels, the compensator including a measurement resistor, the compensator to control a resistance value of the measurement resistor, the measurement resistor to convert the first pixel current corresponding to the first data voltage into a first measured voltage and the second pixel current corresponding to the second data voltage into a second measured voltage. The display device may also include a sensing driver to apply the sensing scan signal to the sensing transistor. The compensator may control the measurement resistor according to a first voltage difference between the first data voltage and the first measured voltage. The compensator may control the measurement resistor according to the first voltage difference, the first data voltage and a reference voltage difference between a reference measured voltage corresponding to a pixel current generated when the first data voltage is input into a reference pixel having a predetermined reference threshold voltage and reference mobility. The compensator may control the measurement resistor according to a second voltage difference between the second data voltage and the second measured voltage. The compensator may control the measurement resistor according to the second data voltage, the second voltage difference and a reference voltage difference between a reference measured voltage corresponding to second pixel current generated when the second data voltage is input into a reference pixel having a predetermined reference threshold voltage and reference mobility.

The compensator may include a measurement unit to measure the first and second pixel current of the pixels, a target unit to eliminate noise generated by the measurement unit, a comparator to compare output values of the measurement unit and the target unit and a successive approximation register (SAR) logic to process an output value of the comparator. The measurement unit may include the measurement resistor and a differential amplifier to output a difference between a predetermined test data voltage and the voltage converted from the first and second pixel currents. The differential amplifier may include a non-inverting input terminal to receive the first and second data voltages, an inverting input terminal to receive the voltage converted from the first and second pixel currents and an output terminal to output a difference between one of the first and second data voltage and the voltage converted from the corresponding one of the first and second pixel current.

The measurement resistor may include a plurality of resistors connected in series and a plurality of control switches connected in parallel to the plurality of resistors, respectively. The measurement resistor may include a base resistor to determine a minimum resistance value of the measurement resistor, a first resistor unit to lower an overall resistance value of the measurement resistor and a second resistor unit to raise an overall resistance value of the measurement resistor.

The first resistor unit may include at least one resistor and at least one control switch connected in parallel with each of the at least one resistor, the at least one control switch being initially set to an open state. The second resistor unit may include at least one resistor and at least one control switch connected in parallel with each of the at least one resistor, the at least one control switch being initially set to a closed state.

The target unit may be configured in a same manner as the measurement unit by being connected to a reference pixel having a predetermined reference threshold voltage and reference mobility. The target unit may output a target voltage that is a target value of the difference between the predetermined test data voltage and the voltage converted from one of the first and second pixel currents. The comparator may include a non-inverting input terminal to receive an output voltage of the measurement unit, an inverting input terminal to receive an output voltage of the target unit and an output terminal to output a difference between the output voltage of the measurement unit and the output voltage of the target unit.

Each of the plurality of pixels may include the organic light emitting diode, the driving transistor having a gate electrode to which the data voltage is applied, one end connected to an ELVDD power source and the other end connected to an anode electrode of the organic light emitting diode and a sensing transistor having a gate electrode to which a sensing scan signal to transmit the pixel currents to the compensator is applied, one end of the sensing transistor being connected to the other end of the driving transistor, and the other end connected to a data line to which the data voltage is applied.

According to another aspect of the present invention, there is provided a method for driving a display device, including setting a threshold voltage of a driving transistor of a measured pixel by comparing a pixel current of a reference pixel to a pixel current of the measured pixel, measuring a first pixel current by controlling a measurement resistor that converts the first pixel current into a first measured voltage, the first pixel current being generated by applying a first data voltage applied with the set threshold voltage to the measured pixel, measuring a second pixel current by controlling the measurement resistor that converts the second pixel current into a second measured voltage, the second pixel current being generated by applying a second data voltage applied with the set threshold voltage to the measured pixel, calculating the actual threshold voltage and mobility of the driving transistor of the measured pixel from the first pixel current and the second pixel current and calculating an image data compensation amount to compensate the actual threshold voltage and mobility of the measured pixel. The method may also include generating an image data signal that reflects the image data compensation amount.

In the setting of the threshold voltage, a threshold voltage difference of the driving transistor of the measured pixel with respect to a driving transistor of the reference pixel may be calculated by measuring a maximum pixel current generated when a data voltage that generates the maximum pixel current is applied to the measured pixel. The measurement resistor may be controlled according to a first voltage difference between the first data voltage and the first measured voltage. The measurement resistor may be controlled according to the first data voltage, the first voltage difference and a reference voltage difference between a reference measured voltage corresponding to a pixel current generated when the first data voltage is input into the reference pixel. The measurement resistor may be controlled according to a second voltage difference between the second data voltage and the second measured voltage. The measurement resistor may be controlled according to the second data voltage, the second voltage difference and a reference voltage difference between a reference measured voltage corresponding to a pixel current generated when the second data voltage is input into the reference pixel. The first data voltage and the second data voltage may be data voltages corresponding to different gray scale levels. Each of the first and second data voltages may be a data voltage that generates the maximum pixel current. Each of the first and second data voltages may be a data voltage that generates the minimum pixel current. The resistance value of the measurement resistor may be controlled according to the gray scale levels corresponding to the first and second data voltages.

BRIEF DESCRIPTION OF THE DRAWINGS

A more complete appreciation of the invention and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
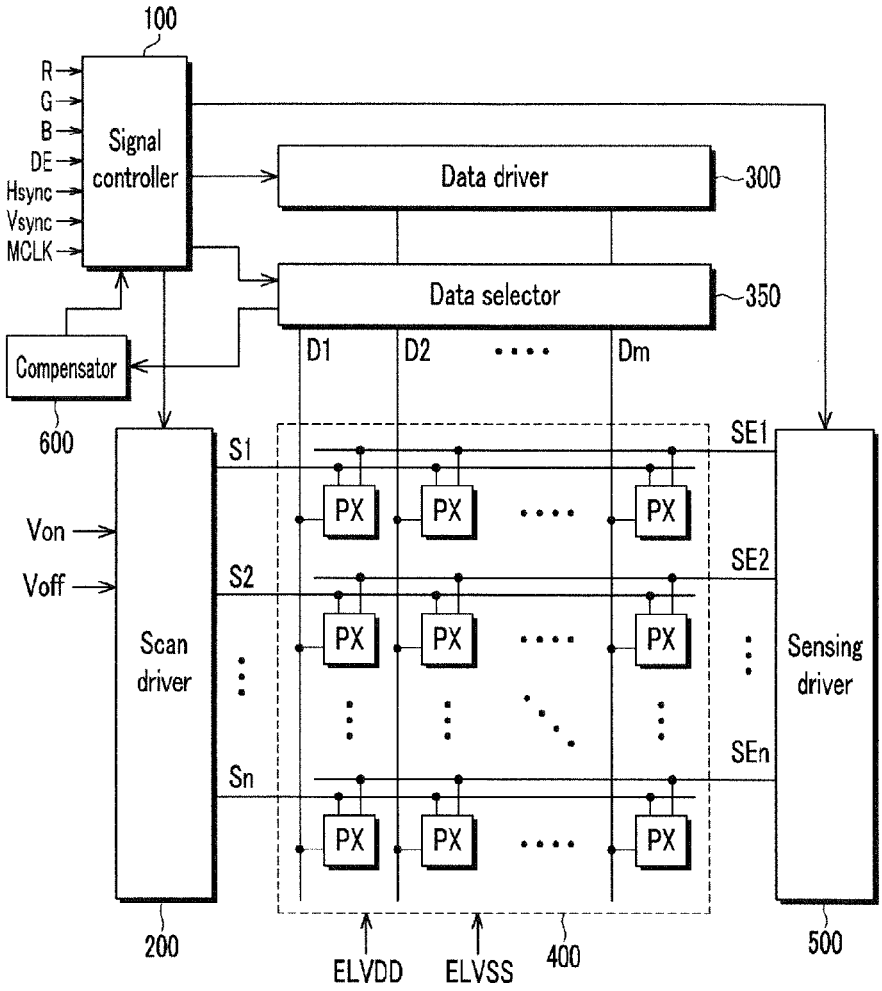
FIG. 1 is a block diagram showing an organic light emitting display according to an exemplary embodiment of the present invention.

Exemplary embodiments of the invention will now be described in detail such that those skilled in the art can easily implement it with reference to the accompanying drawings. As those skilled in the art would realize, the described embodiments may be modified in various different ways, all without departing from the spirit or scope of the present invention.

Constituent elements having the same structures throughout the embodiments are denoted by the same reference numerals and are described in a first exemplary embodiment. In the other exemplary embodiments, only other constituent elements are described. To clearly describe the exemplary embodiments of the present invention, parts not related to the description are omitted, and like reference numerals designate like constituent elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

Figure 2:
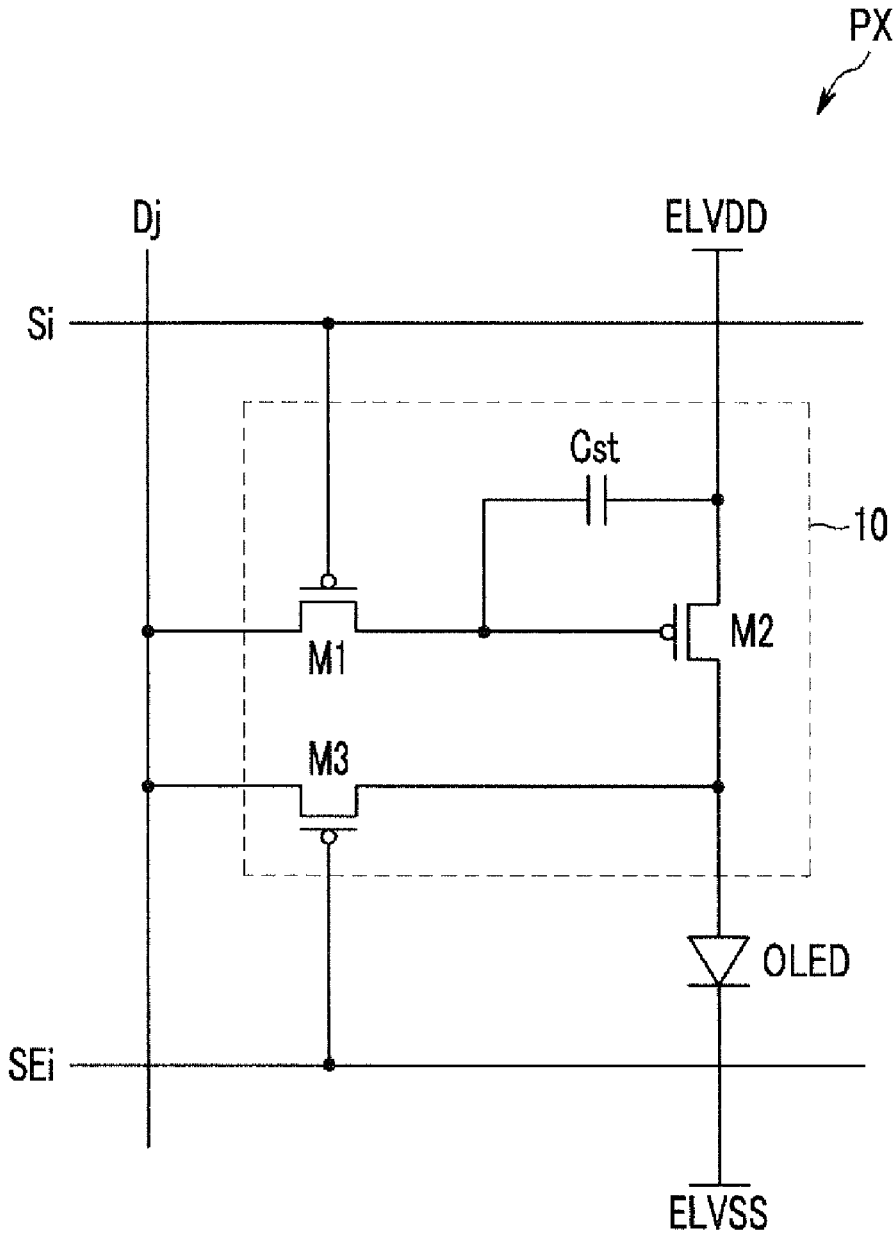
FIG. 2 is a circuit diagram showing a pixel according to the exemplary embodiment of the present invention.
Figure 3:
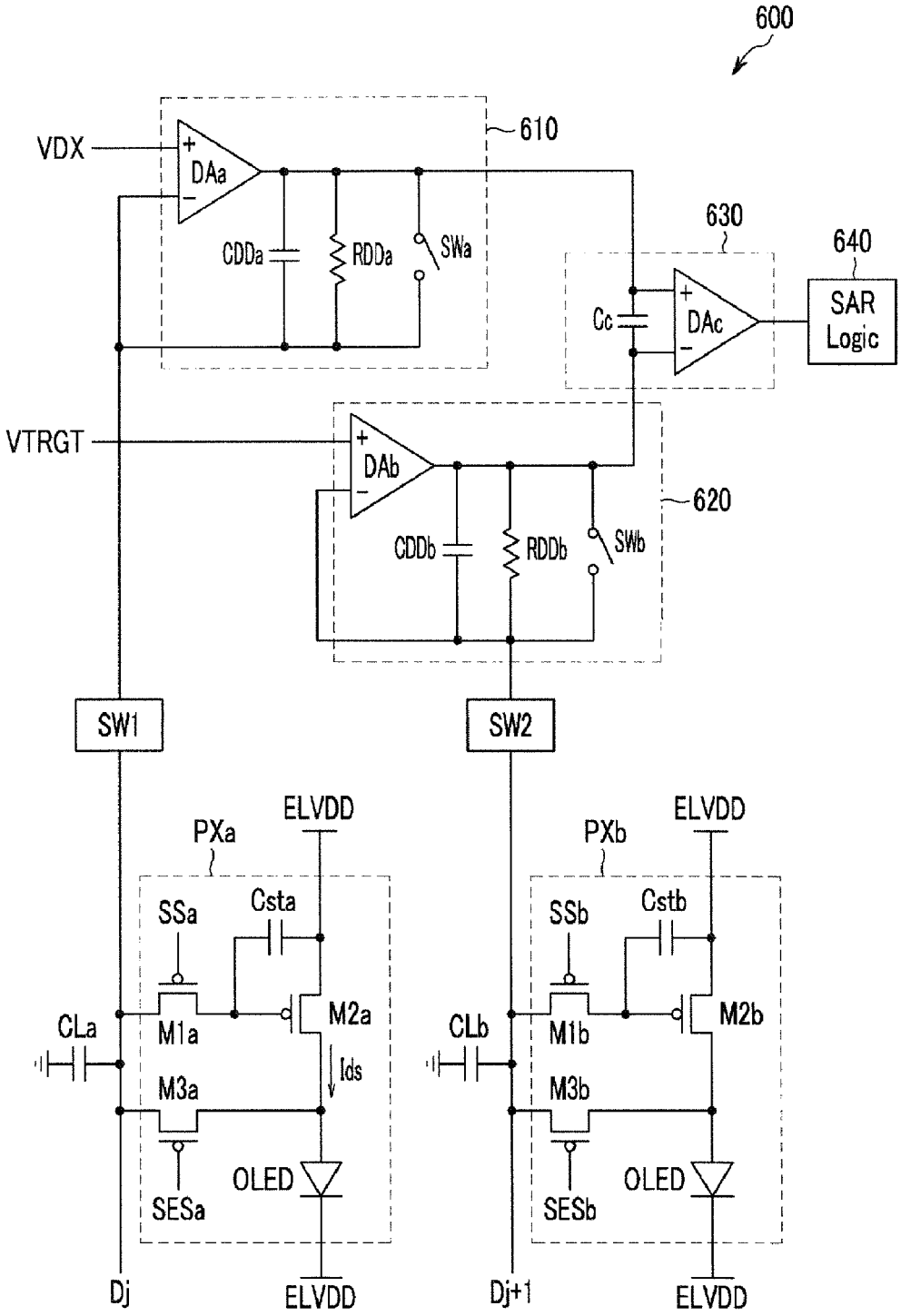
FIG. 3 is a circuit diagram showing a compensator according to an exemplary embodiment of the present invention.
Figure 4:
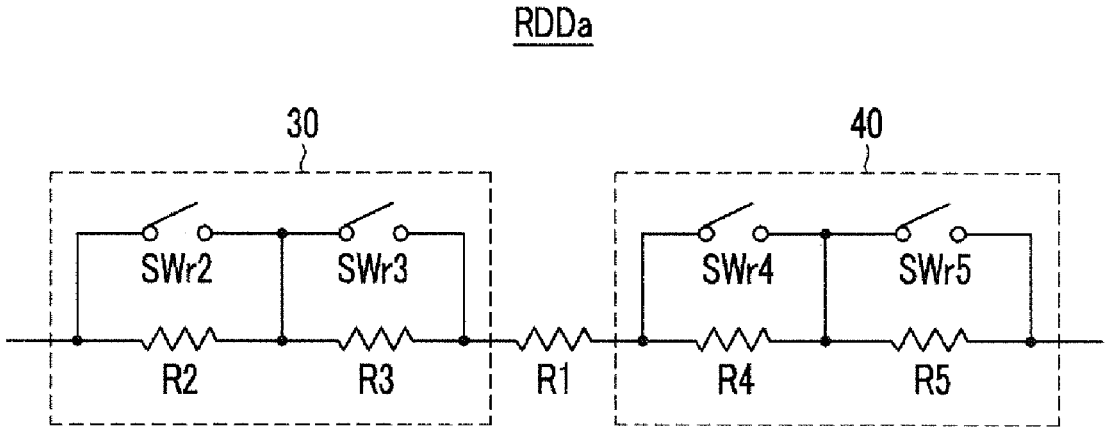
FIG. 4 is a circuit diagram showing a measurement resistor according to an exemplary embodiment of the present invention.
Figure 5:
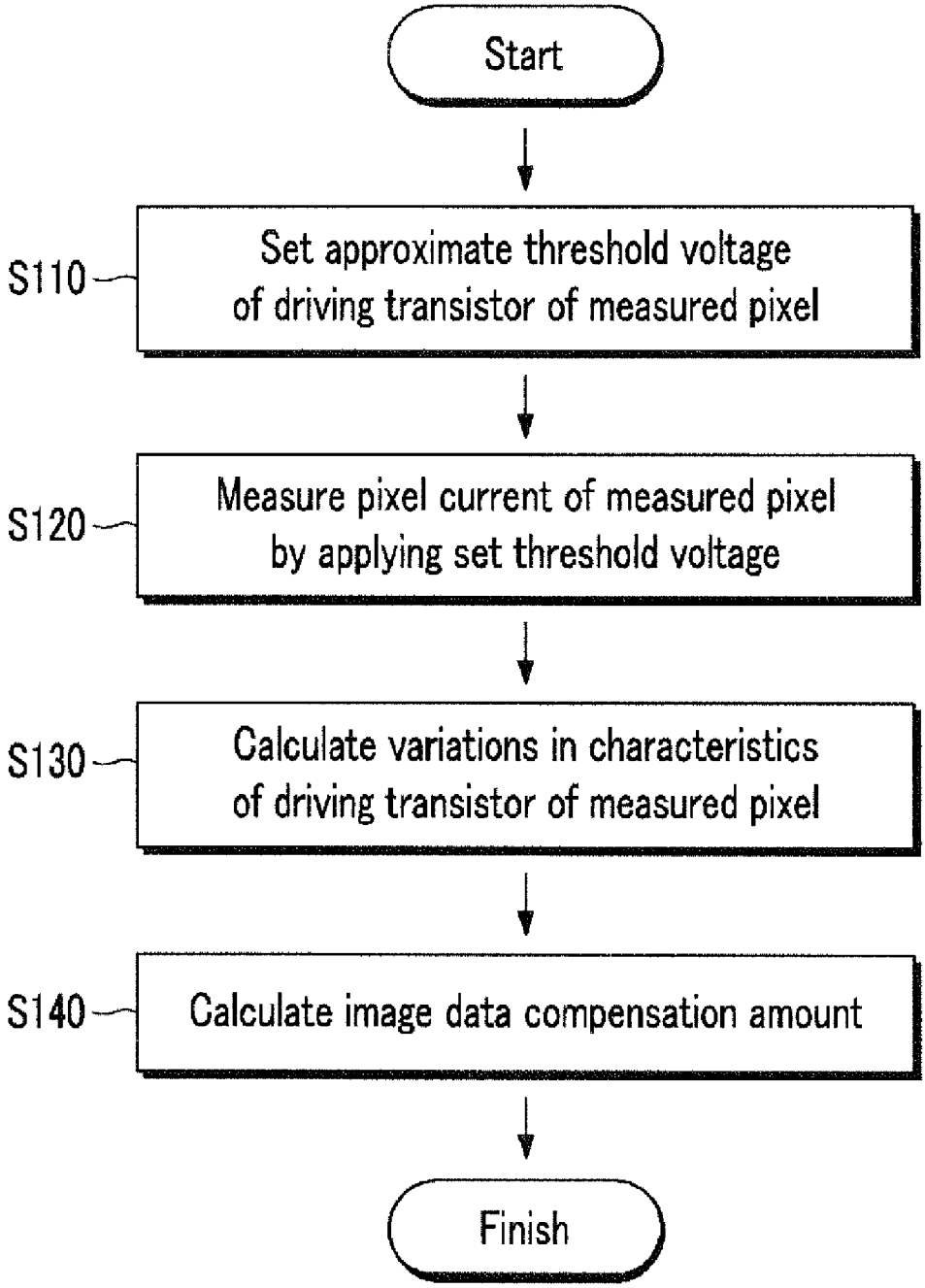
FIG. 5 is a flowchart showing a method for driving an organic light emitting display according to an exemplary embodiment of the present invention.

FIG. 1 is a block diagram showing an organic light emitting display according to an exemplary embodiment of the present invention, FIG. 2 is a circuit diagram showing a pixel according to an exemplary embodiment of the present invention, FIG. 3 is a circuit diagram showing a compensator according to an exemplary embodiment of the present invention, FIG. 4 is a circuit diagram showing a measurement resistor according to an exemplary embodiment of the present invention and FIG. 5 is a flowchart showing a method for driving an organic light emitting display according to an exemplary embodiment of the present invention.

Referring to FIG. 1, the organic light emitting display includes a signal controller 100, a scan driver 200, a data driver 300, a data selector 350, a display unit 400, a sensing driver 500, and a compensator 600. The signal controller 100 receives image signals R, G, and B and input control signals from the outside to control display of the R, G, and B colors. The image signals R, G, and B include luminance information of each pixel PX, the luminance having a predetermined number of grays, for example 1024 ($=2^{10}$), 256 ($=2^{8}$), or 64 ($=2^{6}$). Examples of the input control signals include a vertical synchronization signal Vsync, a horizontal synchronization signal Hsync, a main clock signal MCLK, a data enable signal DE, etc.

The signal controller 100 appropriately processes the input image signals R, G, and B according to the operation conditions of the display unit 400 on the basis of the image signals R, G, and B along with the input control signals, and generates a scan control signal CONT1, a data control signal CONT2, an image data signal DAT, and a sensing control signal CONT3. The signal controller 100 transmits the scan control signal CONT1 to the scan driver 200, the data control signal CONT2 and the image data signal DAT to the data driver 300, the sensing control signal CONT3 to the sensing driver 500 and a selection signal to the data selector 350. Signal controller 100 also controls the operation of selection switches SW1 and SW2 located within data selector 350 and illustrated in FIG. 3.

The display unit 400 includes a plurality of pixels PX that are connected to a plurality of scan lines S1 to Sn, a plurality of data lines D1 to Dm and a plurality of sensing lines SE1 to SEn and are arranged in an approximate matrix form. The plurality of scan lines S1 to Sn and the plurality of sensing lines SE1 to SEn extend in an approximate row direction and are almost parallel with each other, and the data lines D1 to Dm extend in an approximate column direction and are almost parallel with each other. The plurality of pixels PX of the display unit 400 are supplied with a first power supply voltage ELVDD and a second power supply voltage ELVSS from the outside.

The scan driver 200 is connected to the plurality of scan line S1 to Sn, and applies a scan signal to the plurality of scan lines S1 to Sn according to the scan control signal CONT1, the scan signal including a combination of a gate-on voltage $V_{on}$ for turning on a switching transistor M1 of FIG. 2 and a gate-off voltage $V_{off}$ for turning it off.

The data driver 300 is connected to the plurality of data lines D1 to Dm and selects a gray scale voltage according to the image data signal DAT. The data driver 300 applies the gray scale voltage as a data signal, which is selected according to the data control signal CONT2 to the plurality of data lines D1 to Dm.

The data selector 350 is connected to the plurality of data lines D1 to Dm, and includes the selection switches SW1 and SW2 illustrated in FIG. 3 respectively connected to the data lines D1 to Dm. The data selector 350 controls the selection switches in response to a selection signal transmitted from the signal controller 100, to thus transmit data signals to the plurality of pixels PX or to transmit pixel currents generated in the pixels PX to the compensator 600.

The sensing driver 500 is connected to the plurality of sensing lines SE1 to SEn, and applies a sensing scan signal for turning a sensing transistor M3 illustrated in FIG. 2 on or off according to the plurality of sensing lines SE1 to SEn according to the sensing control signal CONT3.

The compensator 600 receives the pixel currents used to detect characteristics of driving transistors of the pixels, and calculates an image data compensation amount for compensating for variations of the plurality of driving transistors of the pixels. In the first measurement, the compensator 600 applies a predetermined data voltage to the driving transistor of a pixel that is being measured, and measures the current (hereinafter, pixel current) flowing through the organic light emitting diode. The predetermined data voltage refers to a voltage that causes the maximum current corresponding to the highest gray scale level to flow through the organic light emitting diode. By using the measured pixel current, the compensator 600 approximately calculates a threshold voltage difference of the driving transistor of the measured pixel with respect to the driving transistor of a reference pixel.

The compensator 600 performs the second measurement of the pixel current by allowing the calculated threshold voltage difference to be added to the data voltage, and calculates the actual threshold voltage and mobility of each pixel by using the second measured pixel current and the data voltage applied to the driving transistor of the measured pixel. The compensator 600 calculates the actual threshold voltage and mobility of the measured pixel by measuring the first pixel current generated by the first data voltage and the second pixel current generated by the second data voltage, the first and second data voltages corresponding to different gray scale levels. At this point, the compensator 600 can measure the pixel current more precisely by controlling the resistance value of a measurement resistor used to convert the first pixel current into a first measured voltage and the second pixel current into a second measured voltage in accordance with gray scale levels corresponding to the data voltages.

The compensator 600 calculates an image data compensation amount from the actual threshold voltage and mobility of each pixel, and transmits it to the signal controller 100. The signal controller 100 generates the image data signal DAT that reflects the image data compensation amount received from the compensator. A detailed description thereof will be given later.

Referring to FIG. 2, a pixel PX of the organic light emitting display includes an organic light emitting diode OLED and a pixel circuit 10 for controlling the organic light emitting diode. The pixel circuit 10 includes a switching transistor M1, a driving transistor M2, a sensing transistor M3, and a sustain capacitor Cst.

The switching transistor M1 has a gate electrode connected to the scan line S1, one end connected to the data line Dj, and the other end connected to a gate electrode of the driving transistor M2.

The driving transistor M2 has a gate electrode connected to the other end of the switching transistor M1, one end connected to an ELVDD power source, and the other end connected to an anode electrode of the organic light emitting diode OLED.

The sustain capacitor Cst has one end connected to the gate electrode of the driving transistor M2 and the other end connected to the ELVDD power source. The sustain capacitor Cst charges a data voltage applied to the gate electrode of the driving transistor M2, and sustains the data voltage even after the switching transistor M1 is turned off.

The sensing transistor M3 has a gate electrode connected to the sensing line SEi, one end connected to the other end of the driving transistor M2, and the other end connected to the data line Dj.

The organic light emitting diode OLED has an anode electrode connected to the other end of the driving transistor M2 and a cathode electrode connected to an ELVSS power source.

The switching transistor M1, the driving transistor M2, and the sensing transistor M3 may be p-channel electric field effect transistors. The gate-on voltage for turning on the switching transistor M1, the driving transistor M2, and the sensing transistor M3 is a low voltage, and the gate-off voltage for turning them off is a high voltage.

Although the p-channel field effect transistors have been illustrated herein, at least one of the switching transistor M1, the driving transistor M2, and the sensing transistor M3 may be an n-channel electric field effect transistor. The gate-on voltage for turning on the n-channel electric field effect transistor is a high voltage, and the gate-off voltage for turning it off is a low voltage.

When the gate-on voltage $V_{on}$ is applied to the scan line S1, the switching transistor M1 is turned on, and a data signal applied to the data line Dj is applied to one end of the sustain capacitor Cst through the turned-on switching transistor M1 to charge the sustain capacitor Cst. The driving transistor M2 controls the amount of current flowing from the ELVDD power source to the organic light emitting diode OLED corresponding to a voltage value charged within the sustain capacitor Cst. The organic light emitting diode OLED generates light corresponding to the amount of current flowing through the driving transistor M2. At this point, the gate-off voltage is applied to the sensing line SEi to turn off the sensing transistor M3, and the current flowing through the driving transistor M2 does not flow through the sensing transistor M3.

The organic light emitting diode OLED may emit light of one primary color. The primary colors include, for example, three primary colors of red, green, and blue, and a desired color is displayed with a spatial or temporal sum of the three primary colors. In this case, the organic light emitting diode OLED may partially emit white light, and accordingly luminance is increased. Alternatively, the organic light emitting diodes OLEDs of all pixels PX may emit white light, and some of the pixels PX may further include a color filter (not shown) that changes white light emitted from the organic light emitting diodes OLEDs to light of one of the primary colors.

Each driving device 100, 200, 300, 350, 500, and 600 may be directly mounted on the display unit 400 in the form of at least one integrated circuit chip, mounted on a flexible printed circuit film, attached to the display unit 400 in the form of a tape carrier package (TCP), or mounted on a separate printed circuit board (PCB). Alternatively, they may be integrated in the display unit 400 together with the signal lines S1 to Sn, D1 to Dm, and SE1 to SEn.

It is assumed that the organic light emitting display according to the present invention is driven by frames, each of which includes a data writing period during which data signals are transmitted to the respective pixels and written therein, a light emission period during which all the pixels emit light at the same time after completion of the writing of the data signals corresponding to the respective pixels, and a compensation period during which characteristics of the driving transistors of the respective pixels are detected and characteristic variations are compensated for. The compensation period may occur once every predetermined number of frames, rather than every frame, to compensate for the variations in the characteristics of the driving transistors of the respective pixels. Moreover, the organic light emitting display of the present invention may operate in a sequential driving manner in which each pixel emits light upon completion of the data writing period.

Referring to FIG. 3, the compensator 600 includes a measurement unit 610 for measuring the pixel current of a measured pixel PXa, a target unit 620 for eliminating noise generated by the measurement unit 610, a comparator 630 for comparing output values of the measurement unit 610 and the target unit 620, and a successive approximation register (SAR) logic 640 for processing an output value of the comparator 630.

The measurement unit 610 is connected to the data line Dj of the measured pixel PXa by a first selection switch SW1, the target unit 620 is connected to the data line Dj+1 of a reference pixel PXb by a second selection switch SW2, and the comparator 630 compares the output voltages of the measurement unit 610 and the target unit 620 and transmits the comparison result to the SAR logic 640.

The measured pixel PXa represents a pixel serving as an object of measurement of variations in characteristics of the driving transistor M2 that is being measured, and the reference pixel PXb indicates the pixel serving as a reference point for measuring the measured pixel PXa. The reference pixel PXb is a pixel having a predetermined reference threshold voltage and reference mobility, which may be any one of the plurality of pixels included in the display unit 400 or a pixel provided separately to compensate for variations in characteristics of the driving transistors. The reference pixel PXb is a dummy pixel to which no data voltage is written according to an image signal, and its threshold voltage and mobility are obtained upon completion of fabrication are not changed.

During the compensation period, an ELVDD voltage may be applied to cathode electrodes of the organic light emitting diodes OLEDs of the measured pixel PXa and the reference pixel PXb. Upon doing so, no current flows in the organic light emitting diodes OLEDs during the compensation period.

A first panel capacitor CLa is connected to the data line Dj connected to the measured pixel PXa, and a second panel capacitor CLb is connected to the data line Dj+1 connected to the reference pixel PXb. The first panel capacitor CLa and the second panel capacitor CLb each have one end connected to a data line and the other end connected to ground. The panel capacitors may be respectively connected to the plurality of data lines D1 to Dm included in the display unit 400. The panel capacitors are used to represent the parasitic capacitance on each data line in the form of a circuit.

The measurement unit 610 includes a first differential amplifier DAa, a measurement capacitor CDDa, a measurement resistor RDDa, and a first reset switch SWa. The first differential amplifier DAa includes a non-inverting input terminal (+) for receiving a predetermined test data voltage VDX, an inverting input terminal (−) connected to the data line Dj of the measured pixel PXa, and an output terminal connected to the comparator 630. Each of the measurement capacitor CDDa, the measurement resistor RDDa and the first reset switch SWa has one end connected to the output terminal of the first differential amplifier DAa and the other end connected to the data line Dj of the measured pixel PXa.

The target unit 620 includes a second differential amplifier DAb, a target capacitor CDDb, a target resistor RDDb, and a second reset switch SWb. The target unit 620 is configured in the same manner as the measurement unit 610, and generates the same noise as the measurement unit 610. The noise generated by the target unit 620 is transmitted to the inverting input terminal (−) of the comparator 630 and accordingly compensates for the noise included in the output of the measurement unit 610 and input into the non-inverting input terminal (+).

The second differential amplifier DAb includes a non-inverting input terminal (+) for receiving a target voltage VTRGT, an inverting input terminal (−) connected to the data line Dj+1 of the reference pixel PXb, and an output terminal connected to the comparator 630. Each of the target capacitor CDDb, the target resistor RDDb and the second reset switch SWb has one end connected to the output terminal of the second differential amplifier DAb and the other end connected to the data line Dj+1 of the reference pixel PXb.

The test data voltage VDX is a value that causes a predetermined pixel current of the measured pixel PXa to flow, and the target voltage VTRGT is a target value of a difference between a voltage generated when the predetermined pixel current flows through the measurement resistor RDDa and the test data voltage VDX.

Specifically, during the compensation period, when the switching transistor M1*a* is turned on and the cathode voltage of the organic light emitting diode OLED becomes ELVDD, if the test data voltage VDX is applied to the non-inverting input terminal (+) of the first differential amplifier DAa, the same voltage as the test data voltage VDX is generated in the inverting input terminal (−) as well.

The test data voltage VDX generated in the inverting input terminal (−) flows through to the gate electrode of the driving transistor M2*a* along the data line Dj and through switching transistor M1. The test data voltage VDX is input into the gate electrode of the driving transistor M2*a* to cause electric current to flow therein. At this time, when the sensing transistor M3*a* is turned on, a pixel current Ids flows to the measurement resistor RDDa.

The pixel current Ids is converted into a measured voltage RDDa*Ids by the measurement resistor RDDa. The measured voltage is input into the inverting input terminal (−) of the first differential amplifier DAa, and the first differential amplifier DAa outputs a difference between the test data voltage VDX and the measured voltage RDDa*Ids. Hereinafter, an output voltage of the first differential amplifier DAa is referred to as a first amplified voltage VAMP1.

The target voltage VTRGT is a target value of the output voltage of the first differential amplifier DAa. If a voltage difference between the test data voltage VDX and the measured voltage RDDa*Ids is equal to the target voltage VTRGT, it is determined that the characteristics of the driving transistor M2*a* of the measured pixel PXa is identical to the characteristics of the driving transistor M2*b* of the reference pixel PXb.

The comparator 630 includes a third differential amplifier DAc and a comparison capacitor Cc. The third differential amplifier DAc includes a non-inverting input terminal (+) connected to the output terminal of the first differential amplifier DAa, an inverting input terminal (−) connected to the output terminal of the second differential amplifier DAb, and an output terminal connected to the SAR logic 640. The comparison capacitor Cc has one end connected to the output terminal of the first differential amplifier DAa and the other end connected to the output terminal of the second differential amplifier DAb.

The SAR logic 640 is connected to the output terminal of the third differential amplifier DAc to calculate the actual threshold voltage and actual mobility of the driving transistor M2 of each measured pixel and to calculate an image data compensation amount for each pixel based on the calculated threshold voltage and mobility.

Referring to FIG. 4, the compensator 600 controls the measurement resistor RDDa according to a voltage difference between a data voltage and a measured voltage. To this end, the measurement resistor RDDa of the measurement unit 610 includes a plurality of resistors connected in series and a plurality of control switches connected in parallel to the respective resistors.

The measurement resistor RDDa includes a base resistor R1 and a variable resistor unit. The base resistor R1 is a resistor that determines the minimum resistance value of the measurement resistor RDDa as base resistor R1 is not connected in parallel with a control switch.

The variable resistor unit includes a first resistor unit 30 serves to lower an overall resistance value and a second resistor unit 40 serves to raise an overall resistance value of measurement resistor RDDa. The first resistor unit 30 and the second resistor unit 40 each include at least one resistor and at least one control switch connected in parallel with each resistor. The plurality of resistors included in the variable resistor unit may have different resistance values from each other, and may create various resistance values by being combined with the base resistor R1. Here, it is assumed that each of the first and second resistor units 30 and 40 includes two resistors. The first resistor unit 30 includes resistors R2 and R3 connected in series, a control switch SWr2 connected in parallel with R2, and a control switch SWr3 connected in parallel with R3. The control switches SWr2 and SWr3 of the first resistor unit 30 are initially set to an open state, and the control switches SWr2 and SWr3 are selectively closed when the overall resistance value of the measurement resistor RDDa has to be lowered. Once the control switch SWr2 or SWr3 is closed, the overall resistance value becomes as low as the resistance value of the resistor connected in parallel with the closed control switch.

The second resistor unit 40 includes resistors R4 and R5 connected in series, a control switch SWr4 is connected in parallel with R4, and a control switch SWr5 is connected in parallel with R5. The control switches SWr4 and SWr5 of the second resistor unit 40 are initially set to a closed state, and the control switches SWr4 and SWr5 are selectively opened when the overall resistance value of the measurement resistor RDDa has to be raised. Once the control switch SWr4 or SWr5 is opened, the overall resistance value becomes as high as the resistance of the resistor connected in parallel with the opened control switch.

Now, a method for obtaining an image data compensation amount will be described with reference to FIGS. 1 to 5. The maximum pixel current of the reference pixel PXb and the maximum pixel current of the measured pixel PXa are compared with each other to set an approximate threshold voltage Vth of the measured pixel PXa by the difference between them (S110). Specifically, the threshold voltage of the measured pixel PXa can be set such that, when the difference between the maximum pixel current of the reference pixel PXb and the maximum pixel current of the measured pixel PXa is about 100 nA, the difference in threshold voltage between the reference pixel PXb and the measured pixel PXa is 0.1V. At this time, the threshold voltage of the reference pixel PXb is a known value.

The compensator 600 sets a first data voltage Vdat1 corresponding to a high gray scale level and a second data voltage Vdat2 corresponding to a low gray scale level by applying the set threshold voltage Vth of the measured pixel PXa, transmits these voltages to the measured pixel PXa, and measures a first pixel current Ids1 generated by the first data voltage and a second pixel current Ids2 generated by the second data voltage (S120). Variations in characteristics of the driving transistor M2*a* of the measured pixel PXa are calculated by using the measured first pixel current Ids1 and second pixel current Ids2.

The first test voltage Vdat1 and the second data voltage Vdat2 may be data voltages corresponding to different gray scale levels. For instance, the first data voltage Vdat1 may be a data voltage corresponding to a high gray scale level, and the second data voltage Vdat2 may be a data voltage corresponding to a low gray scale level. Alternatively, the first data voltage Vdat1 may be a data voltage that generates a data voltage corresponding to the highest gray scale level, i.e., maximum pixel current, and the second data voltage Vdat2 may be a data voltage that generates a data voltage corresponding to the lowest gray scale level, i.e., minimum pixel current.

When the first data voltage Vdat1 is input into the non-inverting input terminal (+) of the first differential amplifier DAa, the same voltage as the data voltage Vdat1 is generated in the inverting input terminal (−) of the first differential amplifier DAa. In the state where the switching transistor M1*a* is turned on as a low-voltage scan signal SSa is applied to the gate electrode of the switching transistor M1*a* of the measured pixel PXa and the sensing transistor M3*a* is turned off as a high-voltage sensing scan signal SESa is applied to the gate electrode of the sensing transistor M3*a*, the first data voltage Vdat1 is transmitted to the gate electrode of the driving transistor M2*a* along the data line Dj. At this point, the first selection switch SW1 connects the measurement unit 610 to the measured pixel PXa so that the first data voltage Vdat1 can be applied to the measured pixel PXa.

When the sensing transistor M3*a* is turned on as the low-voltage sensing scan signal SESa is applied to the gate electrode of the sensing transistor M3*a*, the first pixel current Ids1 flowing through the driving transistor M2*a* flows to the measurement unit 610 along the data line Dj. At this point, the first pixel current Ids1 charges the panel capacitor CLa, and the panel capacitor CLa keeps the first pixel current Ids1 continually flowing to the measurement unit 610.

The first pixel current Ids1 flows through the measurement resistor RDDa of measurement unit 610, and the measurement resistor RDDa converts the first pixel current Ids1 into a first measured voltage RDDa*Ids1. The first measured voltage is input into the inverting input terminal (−) of the first differential amplifier DAa.

The first differential amplifier DAa outputs a first voltage difference between the first data voltage Vdat1 and the first measured voltage. The first voltage difference between the first data voltage Vdat1 and the first measured voltage becomes the first amplified voltage VAMP1. The first amplified voltage VAMP1 is input into the non-inverting input terminal (+) of the third differential amplifier DAc.

Meanwhile, no data voltage is applied to the reference pixel PXb, and no ELVDD voltage is applied to the cathode electrode of the organic light emitting diode OLED of reference pixel PXb. That is, no pixel current is generated in the reference pixel PXb, and a voltage generated by the target resistor RDDb is 0V even though the low-voltage sensing scan signal SESb is applied to the sensing transistor M3*b*.

The target voltage VTRGT is input into the non-inverting input terminal (+) of the second differential amplifier DAb, and a voltage VAMP2=VTRGT is output to the output terminal of the second differential amplifier DAb. At this time, the target voltage VTRGT is a target value of the first amplified voltage VAMP1 of the first differential amplifier DAa.

An output voltage VAMP2 of the second differential amplifier DAb is input into the inverting input terminal (−) of the third differential amplifier DAc. The third differential amplifier DAc amplifies a difference between the first amplified voltage VAMP1 input into the non-inverting input terminal (+) and the target voltage VTRGT input into the inverting input terminal (−) and outputs a second amplified voltage. The second amplified voltage is transmitted to the SAR logic 640.

The SAR logic 640 calculates the first pixel current Ids1 of the measured pixel PXa by using the second amplified voltage of the third differential amplifier DAc. The SAR logic 640 corrects the first data voltage Vdat1 so that the calculated first pixel current Ids1 has the same value as the pixel current of the reference pixel PXb.

At this point, the resistance value of the measurement resistor RDDa is controlled so that the first pixel current Ids1 more closely approximates the pixel current of the reference pixel PXb. That is, the resistance value of the measurement resistor RDDa is controlled according to the first data voltage Vdat1, the first voltage difference and a reference voltage difference between a reference measured voltage corresponding to a pixel current, generated when the first data voltage Vdat1 is input into the reference pixel PXb.

If the measurement range of the SAR logic 640 is limited to 0 to 3V, the measurement resistor RDDa is set to a resistance value that allows the second amplified voltage caused by the difference between the first amplified voltage VAMP1 and the target voltage VTRGT to fall within the range of 0 to 3V by taking panel distribution into consideration. Afterwards, when the first pixel current Ids1 generated by the first data voltage Vdat1 corresponding to the high gray scale level flows, the measurement resistor RDDa is controlled by taking the first pixel current Ids1 into consideration. That is, the compensator 600 controls the measurement resistor RDDa according to the first voltage difference between the first data voltage Vdat1 and the first measured voltage.

For example, if the difference between the first amplified voltage VAMP1, generated when the first data voltage Vdat1 is applied to the measured pixel PXa, and the target voltage VTRGT is large, a measurement error may occur. On the contrary, if the difference between the first amplified voltage VAMP1 and the target voltage VTRGT is small, the accuracy of measurement is reduced. If the difference between the two voltages is large, the measurement resistor RDDa is controlled so that the difference between the two voltages is reduced, and if the difference between the two voltages is small, the measurement resistor RDDa is controlled so that the difference between the two voltages is increased, whereby the first pixel current Ids1 is measured again. For instance, if the first amplified voltage VAMP1 is much smaller than the target voltage VTRGT, the measurement resistor RDDa is reduced to increase the first amplified voltage VAMP1. On the contrary, if the first amplified voltage VAMP1 is much greater than the target voltage VTRGT, the measurement resistor RDDa is increased to reduce the first amplified voltage VAMP1.

The second pixel current Ids2 is measured in the same manner as the measurement of the first pixel current Ids1. That is, the measurement resistor RDDa is controlled according to a second voltage difference between the second data voltage Vdat2 and a second measured voltage, which is converted from the second pixel current Ids2 generated by the second data voltage Vdat2. The resistance value of the measurement resistor RDDa is controlled so that the second pixel current Ids2 more closely approximates the pixel current of the reference pixel PXb. The resistance value of the measurement resistor RDDa is controlled according to a reference voltage difference between a reference measured voltage corresponding to a pixel current, generated when the second data voltage Vdat2 is input into the reference pixel PXb, and the second data voltage Vdat2.

The magnitude of current per gray scale at a high gray level and the magnitude of current per gray scale at a low gray level are different from each other. As described above, the measurement range of pixel current can be extended and the accuracy of measurement can be improved by controlling the resistance value of the measurement resistor RDDa according to a data voltage corresponding to a high gray scale level and a data voltage corresponding to a low gray scale level.

The SAR logic 640 calculates variations in characteristics of the driving transistor M2*a* of the measured pixel PXa by using the measured first pixel current Ids1 and second pixel current Ids2 (S130). That is, the SAR logic 640 calculates the actual threshold voltage and mobility of the driving transistor M2*a* of the measured pixel PXa.

Equation 1 is one example showing the relationship between the first pixel current Ids1 and the threshold voltage and mobility.

$$Ids1=(\beta+\delta\beta/2)\{(ELVDD-Vdat1)-(Vth+\delta Vth)\}^2 \quad \text{(Equation 1)}$$

Herein, β represents mobility.

Equation 2 is one example showing the relationship between the second pixel current Ids2 and the threshold voltage and mobility.

$$Ids2=(\beta+\delta\beta/2)\{(ELVDD-Vdat2)-(Vth+\delta Vth)\}^2 \quad \text{(Equation 2)}$$

From equations 1 and 2, the actual threshold voltage of the measured pixel PXa can be obtained. Equation 3 is one example showing the actual threshold voltage of the measured pixel.

$$Vth+\delta Vth = \left(\frac{Ids1}{Ids2}\right)^{1/2}\times(ELVDD-Vdat2)\frac{(ELVDD-Vdat1)}{\left(\frac{Ids1}{Ids2}\right)^{1/2}-1} \quad \text{(Equation 3)}$$

From equations 1 and 2, the actual mobility of the measured pixel PXa can be obtained. Equation 4 is one example showing the actual mobility of the measured pixel.

$$\beta+\delta\beta=\frac{2(Ids1+Ids2)-2(Ids1\times Ids2)^{1/2}}{(Vdat2-Vdat1)^2} \quad \text{(Equation 4)}$$

The SAR logic 640 calculates an image data compensation amount for compensating for the actual threshold voltage and mobility of transistor M2*a* of the measured pixel PXa (S140).

Equation 5 is one example showing the image data compensation amount.

$$\Delta GRAY=GRAY\times\{(1+\delta\beta/\beta)^{-1/\gamma}-1\} \quad \text{(Equation 5)}$$

Herein, GRAY is a gray scale, ΔGRAY is a gray scale compensation value, and y is a gamma value for mage display. The gray scale compensation value represents the image data compensation amount.

The SAR logic 640 transmits the calculated image data compensation amount to the signal controller 100, and the signal controller 100 generates an image data signal DAT that reflects the image data compensation amount. The signal controller 100 generates an image data signal compensating for variations by adding the image data compensation amount to an image it data signal corresponding to an image signal. The image data signal corresponding to the image signal is an array of digital signals of predetermined bit number, e.g., 8 bits, which determines the gray scale level of a pixel corresponding to every 8 bits. The image data compensation amount is also digital data. The signal controller 100 can generate an image data signal having a predetermined number of bits, e.g., 10 bits, by adding the image data compensation amount to the image data signal of 8 bits corresponding to the image signal.

While exemplary embodiments of the present invention have been particularly shown and described with reference to the accompanying drawings, the specific terms used herein are used for the purpose of describing the invention and are not intended to define the meanings thereof or be limiting of the scope of the invention set forth in the claims. Therefore, those skilled in the art will understand that various modifications and equivalent other embodiments of the present invention are possible. Consequently, the true technical protective scope of the present invention must be determined based on the technical spirit of the appended claims.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A display device, comprising:

a display unit comprising a plurality of pixels, each of said plurality of pixels includes a driving transistor and a light emitting diode;

a compensator to receive first and second pixel currents generated by the plurality of pixels according to first and second data voltages respectively applied to the plurality of pixels, the compensator to calculate an image data compensation amount to compensate for variations in characteristics of the driving transistor of each of said plurality of pixels; and a data selector to transmit the first and second data voltages to the plurality of pixels and to transmit the first and second pixel currents to the compensator, the compensator to measure the first and second pixel currents generated as a result of the first and second data voltages corresponding to different gray scale levels and to calculate an actual threshold voltage and mobility of the driving transistor of each of the pixels, the compensator including a measurement resistor, the compensator to control a resistance value of the measurement resistor, the measurement resistor to convert the first pixel current corresponding to the first data voltage into a first measured voltage and the second pixel current corresponding to the second data voltage into a second measured voltage.

2. The display device of claim 1, the compensator to control the measurement resistor according to a first voltage difference between the first data voltage and the first measured voltage.

3. The display device of claim 2, the compensator to control the measurement resistor according to the first voltage difference, the first data voltage and a reference voltage difference between a reference measured voltage corresponding to a pixel current generated when the first data voltage is input into a reference pixel having a predetermined reference threshold voltage and reference mobility.

4. The display device of claim 1, the compensator to control the measurement resistor according to a second voltage difference between the second data voltage and the second measured voltage.

5. The display device of claim 4, the compensator to control the measurement resistor according to the second data voltage, the second voltage difference and a reference voltage difference between a reference measured voltage corresponding to second pixel current generated when the second data voltage is input into a reference pixel having a predetermined reference threshold voltage and reference mobility.

6. The display device of claim 1, wherein the compensator comprises:

a measurement unit to measure the first and second pixel current of the pixels;

a target unit to eliminate noise generated by the measurement unit;

a comparator to compare output values of the measurement unit and the target unit; and a successive approximation register (SAR) logic to process an output value of the comparator.

7. The display device of claim 6, wherein the measurement unit comprises:

the measurement resistor; and a differential amplifier to output a difference between a predetermined test data voltage and the voltage converted from the first and second pixel currents.

8. The display device of claim 7, wherein the differential amplifier comprises:

a non-inverting input terminal to receive the first and second data voltages;

an inverting input terminal to receive the voltage converted from the first and second pixel currents; and an output terminal to output a difference between one of the first and second data voltage and the voltage converted from the corresponding one of the first and second pixel current.

9. The display device of claim 7, wherein the measurement resistor comprises:

a plurality of resistors connected in series; and a plurality of control switches connected in parallel to the plurality of resistors, respectively.

10. The display device of claim 9, wherein the measurement resistor comprises:

a base resistor to determine a minimum resistance value of the measurement resistor;

a first resistor unit to lower an overall resistance value of the measurement resistor; and a second resistor unit to raise an overall resistance value of the measurement resistor.

11. The display device of claim 10, wherein the first resistor unit comprises:

at least one resistor; and at least one control switch connected in parallel with each of the at least one resistor, the at least one control switch being initially set to an open state.

12. The display device of claim 10, wherein the second resistor unit comprises at least one resistor; and at least one control switch connected in parallel with each of the at least one resistor, the at least one control switch being initially set to a closed state.

13. The display device of claim 7, wherein the target unit is configured in a same manner as the measurement unit by being connected to a reference pixel having a predetermined reference threshold voltage and reference mobility.

14. The display device of claim 13, the target unit to output a target voltage that is a target value of the difference between the predetermined test data voltage and the voltage converted from one of the first and second pixel currents.

15. The display device of claim 6, wherein the comparator comprises:

a non-inverting input terminal to receive an output voltage of the measurement unit;

an inverting input terminal to receive an output voltage of the target unit; and an output terminal to output a difference between the output voltage of the measurement unit and the output voltage of the target unit.

16. The display device of claim 1, wherein each of the plurality of pixels comprises:

the organic light emitting diode;

the driving transistor having a gate electrode to which the data voltage is applied, one end connected to an ELVDD power source and the other end connected to an anode electrode of the organic light emitting diode; and a sensing transistor having a gate electrode to which a sensing scan signal to transmit the pixel currents to the compensator is applied, one end of the sensing transistor being connected to the other end of the driving transistor, and the other end connected to a data line to which the data voltage is applied.

17. The display device of claim 16, further comprising a sensing driver to apply the sensing scan signal to the sensing transistor.

18. A method of driving a display device, comprising:

setting a threshold voltage of a driving transistor of a measured pixel by comparing a pixel current of a reference pixel to a pixel current of the measured pixel;

measuring a first pixel current by controlling a measurement resistor that converts the first pixel current into a first measured voltage, the first pixel current being generated by applying a first data voltage applied with the set threshold voltage to the measured pixel;

measuring a second pixel current by controlling the measurement resistor that converts the second pixel current into a second measured voltage, the second pixel current being generated by applying a second data voltage applied with the set threshold voltage to the measured pixel;

calculating the actual threshold voltage and mobility of the driving transistor of the measured pixel from the first pixel current and the second pixel current; and calculating an image data compensation amount to compensate the actual threshold voltage and mobility of the measured pixel.

19. The method of claim 18, further comprising generating an image data signal that reflects the image data compensation amount.

20. The method of claim 18, wherein, in the setting of the threshold voltage, a threshold voltage difference of the driving transistor of the measured pixel with respect to a driving transistor of the reference pixel is calculated by measuring a maximum pixel current generated when a data voltage that generates the maximum pixel current is applied to the measured pixel.

21. The method of claim 18, wherein the measurement resistor is controlled according to a first voltage difference between the first data voltage and the first measured voltage.

22. The method of claim 21, wherein the measurement resistor is controlled according to the first data voltage, the first voltage difference and a reference voltage difference between a reference measured voltage corresponding to a pixel current generated when the first data voltage is input into the reference pixel.

23. The method of claim 18, wherein the measurement resistor is controlled according to a second voltage difference between the second data voltage and the second measured voltage.

24. The method of claim 23, wherein the measurement resistor is controlled according to the second data voltage, the second voltage difference and a reference voltage difference between a reference measured voltage corresponding to a pixel current generated when the second data voltage is input into the reference pixel.

25. The method of claim 18, wherein the first data voltage and the second data voltage are data voltages corresponding to different gray scale levels.

26. The method of claim 18, wherein each of the first and second data voltages is a data voltage that generates the maximum pixel current.

27. The method of claim 18, wherein each of the first and second data voltages is a data voltage that generates the minimum pixel current.

28. The method of claim 18, wherein the resistance value of the measurement resistor is controlled according to the gray scale levels corresponding to the first and second data voltages.

* * * * *